US005107917A

United States Patent [19]

Larsson

[11] Patent Number: 5,107,917

[45] Date of Patent: Apr. 28, 1992

[54] ARRANGEMENT IN DOORS

[75] Inventor: Nils H. I. Larsson, Halmstad, Sweden

[73] Assignee: Nomafa AB, Halmstad, Sweden

[21] Appl. No.: 655,399

[22] PCT Filed: Aug. 24, 1989

[86] PCT No.: PCT/SE89/00442

§ 371 Date: Feb. 14, 1991

§ 102(e) Date: Feb. 14, 1991

[87] PCT Pub. No.: WO90/02861

PCT Pub. Date: Mar. 22, 1990

[30] Foreign Application Priority Data

Sep. 2, 1988 [SE] Sweden ..... 8803076

[51] Int. Cl.[5] ..... E06B 9/34

[52] U.S. Cl. ..... 160/229.1; 160/237; 160/264

[58] Field of Search ..... 160/238, 133, 237, 264, 160/229.1

[56] References Cited

U.S. PATENT DOCUMENTS

| | | | |
|---|---|---|---|
| 636,787 | 11/1899 | Frankl | 160/237 |
| 1,571,019 | 1/1926 | Lucas | 160/237 X |
| 2,249,927 | 7/1941 | Abramson | 160/237 |
| 2,350,287 | 5/1944 | Michelman | 160/133 |
| 2,404,257 | 7/1946 | Thomas | 160/133 |
| 3,035,275 | 5/1962 | Strebeigh | 160/237 X |
| 3,292,685 | 12/1966 | Clark | 160/264 X |
| 3,583,465 | 6/1971 | Youngs et al. | 160/264 |
| 4,736,785 | 4/1988 | Seuster | 160/264 |
| 4,800,946 | 1/1989 | Rosenoy | 160/264 |

*Primary Examiner*—David M. Purol

*Attorney, Agent, or Firm*—Kane, Dalsimer, Sullivan, Kurucz, Levy, Eisele and Richard

[57] ABSTRACT

An arrangement in doors including a door leaf of a first material provided with an insert of a second material having properties differing from those of the first material. The first and second materials are sufficiently flexible to allow opening and closing of the door leaf by winding the door leaf respectively on and off a roller. The insert is replaceable and is attached to the door leaf by at least one row of loops secured to the door leaf and the insert. The loops are interdigitated and interlocked by a pintle wire inserted through the interdigitated loops to establish a pin seam so that the insert may be detached and re-attached to the door leaf. Further disclosed is a covering fabric which covers the insert and is attached to the door leaf by hoop-and-loop fasteners.

5 Claims, 2 Drawing Sheets

ARRANGEMENT IN DOORS

BACKGROUND OF THE INVENTION

The subject invention concerns an arrangement in doors of the kind comprising at least one door leaf of a first material, which door leaf is provided with an insert of a second material having properties differing from those of the first material. Both the first and the second materials are sufficiently flexible to allow the door to be closed by the door leaf being respectively wound-on and wound-off.

In doors of this kind it is often desirable that the insert of the second material, which is attached to the first material, is in the form of a window through which it is possible to ascertain the presence on the other side of the door of objects, such as a vehicle, or of a person. Such transparent materials are, however, less durable when exposed to mechanical wear than is the material making up the rest of the door leaf. The less durability of such transparent materials is a consequence of the inherent tendency of such materials to crack when exposed to temperature variations. Furthermore, after a period of service the transparent material generally is scratched to such a degree that its see-through properties are almost entirely lost and consequently the transparent window material needs to be replaced. However, to replace the transparent material requires considerable work as the seam must be ripped up and a new piece of material be sewn on. As a rule, this operation requires that the entire door leaf be dismounted.

In some cases it may be advantageous to replace one window possessing certain properties by another window having different properties. For instance, it may be desirable to install windows of tight transparent materials during the winter season while in the summer the use of a transparent material with vent holes therein may be more desirable.

SUMMARY OF THE INVENTION

The subject invention which concerns an arrangement in doors of e.g. the kind defined in the aforegoing provides a possibility of exchanging one section of the material of the door leaf for another, thus eliminating the disadvantages outlined in the aforegoing. This is achieved in accordance with the invention therein that the second material is replaceable and in that it is attached to the first material by means of a device which may be detached from and be reattached to the first material.

Further characteristics of the invention will appear from the dependent claims.

BRIEF DESCRIPTION OF THE DRAWINGS

The invention will be described in closer detail in the following with reference to the accompanying drawings, wherein.

DESCRIPTION OF THE PREFERRED EMBODIMENT

Figure 1:
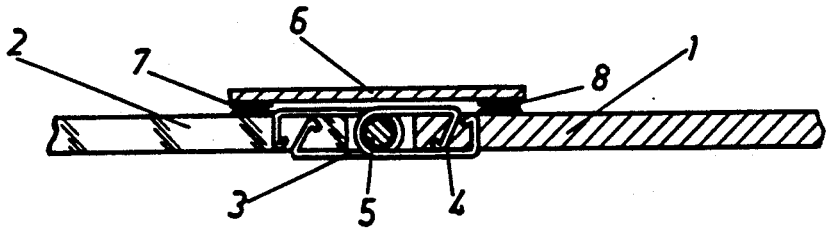
FIGS. 1, 2*a* and 2*b* illustrate two different embodiments of possible means of attachment in accordance with the invention.

FIG. 1 illustrates the joint or seam area bridging the door leaf 1 and the insert piece 2. In accordance with the embodiment illustrated in this drawing figure, the joint or seam is a pin seam comprising rows of loops 3 which are secured to the insert piece or window 2 and loops 4 which are secured to the door leaf 1. The loops 3 and 4 are interdigited and interconnected by means of a pintle wire 5. A covering flap 6 or similar fabric piece covers the seam, said covering flap 6 being secured to the window 2 as well as to the door leaf by means of Velcro, or hoop-and-loop fasteners 7, 8, respectively.

Figure 2A:
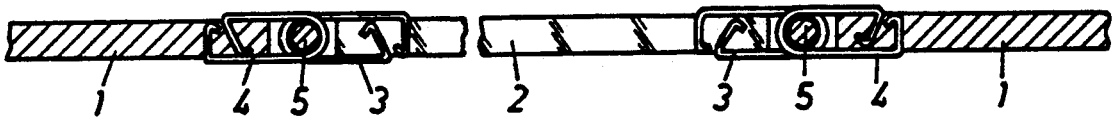
Figure 2B:
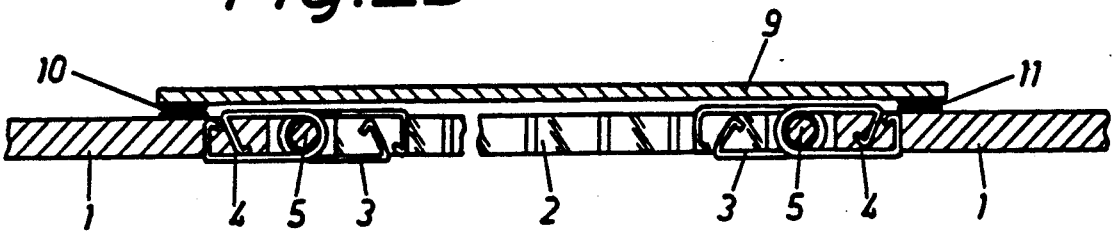

FIG. 2*a* shows the door leaf 1 together with the intermediate window 2 which in this case, like the embodiment illustrated in FIG. 1, is made from a transparent material. Also in this case the door leaf 1 is secured to the window 2 with the aid of a pin seam including loops 3, 4 and a pintle wire 5. FIG. 2*b* illustrates the manner in which the entire window is covered during the winter season in order to prevent heat losses through the window 2. The latter could be provided with apertures or vent holes for purposes of ventilation during the summer season. In the winter, the window is covered by a covering fabric 9 or the like, which is attached to the door leaf on either side of the window 2 with the aid of Velcro (hoop-and-loop) fasteners 10, 11, respectively.

Figure 3:
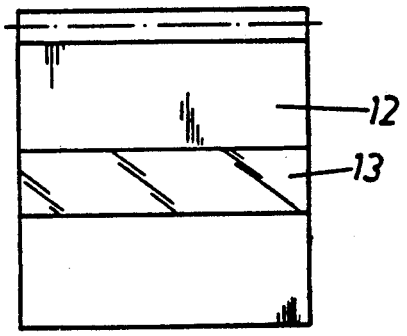
FIGS. 3–6 illustrate different embodiments of varying the insert piece in accordance with the invention.
Figure 4:
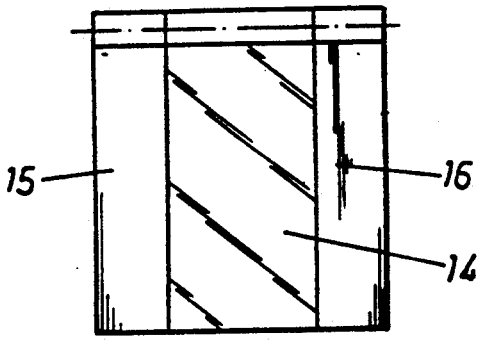
Figure 5:
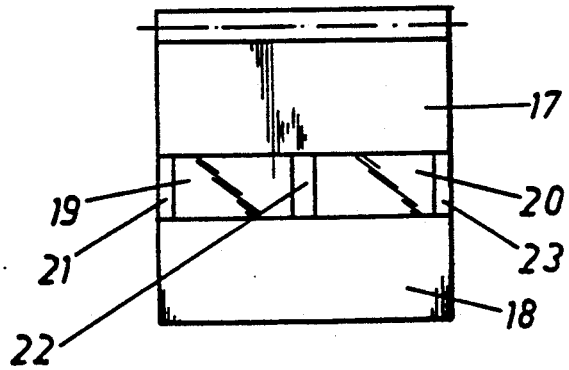
Figure 6:
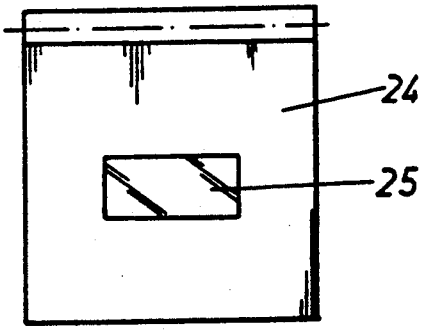

FIG. 3 illustrates a door 12 wherein the window section 13 extends transversely across the entire door leaf. In accordance with the variety shown in FIG. 4 the window 14 extends vertically along the centre of the door leaf, the latter in this case comprising two sections 15 and 16, one on either side of the window section 14. In accordance with the embodiment illustrated in FIG. 5 the door leaf comprises one upper section 17 and one bottom section 18 and the window section is divided into two parts 19 and 20 which are delimited by cross bars 21, 22, and 23. The bars 21, 22, 23 preferably are made from the same material as that of the door leaf sections 17, 18 although this is not absolutely necessary. FIG. 6, finally, shows a door leaf 24 which frames the window section 25 entirely.

The invention is by no means limited to the embodiments described and illustrated in the drawings. For instance, the detachable connection between the window and the door leaf could be achieved in a variety of different ways. In addition to pin seams, spiral seams, zip fasteners and so on could be used. It is possible to use a fastener in the form of an H-profile rail in which case the edges of the door leaf and those of the window are pushed into engagement in apertured legs where they are anchored with the aid of rivets or similar attachment elements, the latter being introduced through the apertures in the rail legs and through corresponding apertures formed in the window section. In addition, the insert piece could be made from other kinds of material than transparent ones. For instance, the insert piece could be a fabric having vent holes made therein to allow ventilation.

The invention is described in the aforegoing when applied in a roll-up door leaf but it goes without saying that it could be used in a number of other flexible door leaves also in structures of other kinds where problems of the nature outlined herein are encountered.

I claim:

1. An arrangement in doors comprising at least one door leaf of a first material, which door leaf is provided with an insert of a second material having properties differing from those of the first material, said first and second materials being sufficiently flexible to allow opening and closing of the door leaf by winding the door leaf respectively on and off a roller, wherein said insert is replaceable and is attached to said door leaf by at least one row of loops secured to each of said door leaf and said insert, said loops being interdigitated and interlocked by means of a pintle wire inserted through said interdigitated loops to establish a pin seam, so that said insert may be detached and re-attached to said door leaf.

2. An arrangement as claimed in claim 1, wherein said pin seam is covered at least one side of the door leaf with a strip of material secured to the door leaf by means of hoop-and-loop fasteners.

3. An arrangement as claimed in claim 1, further comprising a covering fabric, said covering fabric covering said insert and being attached to said door leaf by hoop-and-loop fasteners.

4. An arrangement as claimed in claim 1, wherein the insert extends across an entire width of the door leaf.

5. An arrangement as claimed in claim 1, wherein the insert extends across an entire height of the door leaf.

* * * * *